US009711314B2

(12) United States Patent
Barnett

(10) Patent No.: US 9,711,314 B2
(45) Date of Patent: Jul. 18, 2017

(54) COMPACT MAGNET SYSTEM FOR A HIGH-POWER MILLIMETER-WAVE GYROTRON

(71) Applicant: Larry R. Barnett, Normandy, TN (US)

(72) Inventor: Larry R. Barnett, Normandy, TN (US)

( * ) Notice: Subject to any disclaimer, the term of this patent is extended or adjusted under 35 U.S.C. 154(b) by 0 days.

(21) Appl. No.: 14/848,278

(22) Filed: Sep. 8, 2015

(65) Prior Publication Data

US 2016/0078992 A1 Mar. 17, 2016

Related U.S. Application Data

(60) Provisional application No. 62/049,336, filed on Sep. 11, 2014.

(51) Int. Cl.
*H01J 23/087* (2006.01)

(52) U.S. Cl.
CPC ..... *H01J 23/087* (2013.01)

(58) Field of Classification Search
CPC .. H01J 23/087; H01J 23/0873; H01J 23/0876; H01J 23/10
USPC ..... 315/4, 5, 5.35
See application file for complete search history.

(56) References Cited

U.S. PATENT DOCUMENTS 3,488,550 A 1/1970 Oltman, Jr.
3,896,329 A * 7/1975 Lien ..... H01J 23/087 313/443
4,207,494 A * 6/1980 Hatakenaka et al. . H01J 23/087 315/3.5
4,370,621 A 1/1983 Sprangle
4,395,655 A 7/1983 Wurthman
5,113,162 A * 5/1992 Umehara et al. ..... H01J 29/64 250/396 ML
5,550,432 A 8/1996 Barker
6,768,265 B1 7/2004 Ives
6,847,168 B1 1/2005 Ives
7,764,020 B2 7/2010 Barnett
8,933,651 B2 1/2015 Balakin et al.
2011/0148297 A1* 6/2011 Yasuda et al. ..... B82Y 10/00 315/5.35
2012/0289406 A1 11/2012 Wang et al.
2014/0371076 A1 12/2014 Jongen

* cited by examiner

*Primary Examiner* — Benny Lee
(74) *Attorney, Agent, or Firm* — Louis Ventre, Jr.

(57) ABSTRACT

A compact magnet system for use in a high-power microwave tube includes an electromagnetic coil surrounded on three sides by permanent magnets. More particularly, constituent components include a first tubular retaining member; the electromagnetic coil that fits within the first tubular retaining member and that has a central cavity; first permanent magnets positioned to extend radially from the central cavity so that like poles of the first permanent magnets wrap around the central cavity along a first side of the solenoid coil; and second permanent magnets positioned to extend radially from the central cavity so that opposite poles to the first permanent magnets wrap around the central axis along the second side of the solenoid coil. Optional added components include two sets of permanent magnets, one set on each side of the coil and a pole piece located adjacent to an end of the first tubular retaining member.

7 Claims, 7 Drawing Sheets

COMPACT MAGNET SYSTEM FOR A HIGH-POWER MILLIMETER-WAVE GYROTRON

CROSS-REFERENCE TO RELATED APPLICATION

This application claims the benefit of U.S. Provisional Application No. 62/049,336, filed 11 Sep. 2014, which is hereby incorporated by reference herein.

TECHNICAL FIELD

In the field of discharge devices and power microwave tubes, a combination permanent magnet and electromagnet in a configuration that produces a through-bore magnetic field significantly greater than the magnetic fields from similar individual magnets.

BACKGROUND ART

Power microwave tubes use magnetic flux to emit microwave radiation. The invention has application in magnets for an electron cyclotron maser (also referred to as a gyrotron), a peniotron tube and other types of high frequency microwave tubes that require very high magnetic fields, such as millimeter and submillimeter wave traveling-wave tubes, backward wave oscillators, carcinotrons, and others.

In this application, reference to "power microwave tubes" is intended to be broadly defined to include: (1) high frequency microwave tubes of varying types and interactions; and, (2) microwave generators, especially those that would benefit from higher magnetic fields without using superconducting coils. Gyrotrons and peniotrons, with their microwave cavities, are used as examples herein, but it should be understood that principles discussed apply the larger spectrum of power microwave tubes as defined above.

A gyrotron gyrates the path of a stream of electrons flowing through a microwave cavity in a strong magnetic field and, by doing so, imparts electrons with cyclotron motion while emitting a millimeter wave beam. Essentially, microwaves are generated by maser effects of cyclotron resonance. A peniotron uses the energy exchange between gyrating electrons and a high frequency electromagnetic field structure to generate microwaves. Gyrotrons and peniotrons are high powered electron tubes that convert electron kinetic energy to microwave radiation using a magnetic field.

The present invention encompasses improvements to applicant's prior invention described in U.S. Pat. No. 7,764,020, which is incorporated herein by reference in its entirety. The '020 patent teaches the use of a solid permanent magnet having a through-bore where its magnetic flux density is combined with flux density delivered by an internal electromagnet placed within a cavity of the permanent magnet.

The combination of an electromagnet (interchangeably referred to herein as a solenoid, a coil, a torus-like coil and a solenoid coil) and a permanent magnet in the specified configuration is termed as a "compact magnet system," a "magnet," and alternatively as an "electropermagnet." The electropermagnet may include high-permeability materials (e.g. iron) for added performance improvements.

It is noted that a "toroidal" coil is not used herein because even though a toroidal coil and a "solenoid coil" have the same external shape they are wound differently and have different magnetic fields. A toroidal coil primarily has a high azimuthal magnetic field within the core of the winding, and zero axial (on axis) field. A toroidal coil is commonly used for inductors and transformers. In contrast, a solenoid coil has zero azimuthal field and a maximum axial field (i.e. Bz is maximum on axis at r=0), see FIG. 6.

SUMMARY OF THE INVENTION

A compact magnet system is disclosed for use in a high-power microwave tube. In a first preferred embodiment, a torus-like coil is surrounded on three sides by permanent magnets. This embodiment includes: a first tubular retaining member; the torus-like coil has a central cavity that fits within the first tubular retaining member; first permanent magnets positioned to extend radially from the central cavity so that like poles of the first permanent magnets wrap around the central cavity along a first side of the solenoid coil; and second permanent magnets positioned to extend radially from the central cavity so that opposite poles to the first permanent magnets wrap around the central axis along the second side of the solenoid coil.

In a more complex preferred embodiment, there are two sets of permanent magnets on each side of the coil. These permanent magnets are positioned to radially surround the solenoid coil and the central cavity. In this embodiment, the first tubular retaining member is made of iron and the following added components are present: a second tubular retaining member to hold the first permanent magnets; third permanent magnets positioned to extend radially between the second tubular retaining member and the first tubular retaining member; wherein the same magnetic pole of each third permanent magnet faces the second tubular retaining member and is opposite to the magnetic pole of each of the plurality of first permanent magnets nearest the second tubular retaining member; a third tubular retaining member holds the second permanent magnets; and fourth permanent magnets positioned between the third tubular retaining member and the first tubular retaining member; wherein the same magnetic pole of each fourth permanent magnet faces the third tubular retaining member and is opposite to the magnetic pole of each of the plurality of second permanent magnets nearest the third tubular retaining member.

In preferred embodiments, the first permanent magnets are larger in width than the width of the second permanent magnets.

The compact magnet system may further include a pole piece made of a magnetically permeable material. The pole piece shapes the magnetic field exiting the second permanent magnets. The pole piece is located adjacent to an end of the first tubular retaining member nearest to the plurality of second permanent magnets. The pole piece does not close off the central opening where the electrons flow out of the central cavity.

The pole piece may be angled toward the second permanent magnets and configured to define a gap between the second permanent magnets and the pole piece. The gap may be further configured to provide access to the central cavity to at least one output waveguide that is coupled to the central cavity. The output waveguide preferably has a circular up-taper in order to enable the highest microwave handling capacity.

Technical Problem

The gyrotron, and other cyclotron resonance devices (e.g. peniotrons), have been limited to being essentially laboratory devices because of the requirements to use superconducting magnets to produce the high magnetic fields required for efficient millimeter-wave production. While gyrotrons have been made and designed using permanent magnets, the fields produced are limited to the 1.0-1.2 Tesla range, the magnets are very heavy (e.g. 890 kg) and consequently expensive, and the field reversal within the magnets, limits high power and depressed collectors.

Current electromagnets can reasonably reach 1.0 Tesla. However, above that, the electromagnets are heavy, require large operating power and have severe cooling requirements. To reach desired frequencies on the order of 100 GHz requires operation at higher cyclotron harmonics, e.g. the third harmonic for the 1.2 Tesla magnet, and the fourth harmonic for the 1.0 Tesla magnet to make a 95 GHz gyrotron. The interaction coupling and efficiency of the gyrotron drops very rapidly with the cyclotron harmonic greater than 2, so it is highly desirable to increase the magnetic field and reduce the harmonic number.

High-power microwave tubes above 30 gigahertz frequently employ, and gyrotrons almost exclusively employ, a superconducting magnet system. Major problems with current technology employing a superconducting magnet system reside in the weight of the magnet system and its attendant refrigeration equipment, its contribution to cost and reliability, the continuous power it consumes, and the cool-down time prior to initial operation. Superconducting magnets are expensive and difficult to transport, operate and maintain outside a controlled environment, such as in a laboratory or fixed industrial installation.

Solution to the Problem

The solution is a magnet system for use with millimeter-wave gyrotrons that utilizes a compact, normal, room temperature magnet, or electropermagnet as described herein.

This electropermagnet, using paired radial permanent magnets sandwiching an electromagnet coil, can easily reach magnetic field strengths in the radiofrequency interaction cavity region of 2.0 Tesla. This electropermagnet uses simple tape-wound edge-cooled construction for the electromagnet coils. It is expected that field strengths of at least 2.4 Tesla should be attainable in reasonable size and operating power.

The electropermagnet of FIG. 5 is a drawing of an actual electropermagnet that weighs 22 kg, has an outside diameter of 18 centimeter, and is 13 centimeters long. It produces a continuous magnetic field of 2.0 Tesla in a 30 millimeter bore with a 25 millimeter flat magnetic field, and has been used for a proof of principle 94 gigahertz gyrotron producing 30 kilowatts. A 94 gigahertz, 2nd harmonic design with this magnet, magnetron injection gun beam, and the $TE_{021}$ cavity mode predicts about 30-35% radiofrequency efficiency at output power levels of 40-100 kilowatts.

Advantageous Effects of the Invention

An important advantage of the electropermagnet is that it is a very powerful magnet that may be employed in power microwave tubes that exploit an optimum magnetic-field-strength, or cyclotron harmonic number, thus avoiding the need for superconducting electromagnets.

The present invention improves the magnetic field obtainable over the electropermagnet described in the '020 patent. When certain conditions prevail, such as when incorporating non-linear magnetic materials, the resultant magnetic field obtained can be significantly larger than the sum of the fields of the individual magnets.

An example of an electropermagnet has been made and tested to 2.0 Tesla, has a 30 millimeter internal diameter bore and a 25 millimeter flat field cavity region, suitable for efficient fundamental and 2nd harmonic mode high-power pulse and continuous wave gyrotrons to at least 110 gigahertz, and has a weight of only 22 kilograms.

Gyrotron design with this magnet delivers 40 to 100 kilowatt continuous wave (kWCW) emissions using external high power and depressed collectors, at W-band 94 GHz. The electropermagnet concept is useful for harmonic cyclotron devices operating at reduced harmonic number for higher efficiency interactions into the submillimeter terahertz range. This compact concept is expected to fill millimeter-wave portable and size restricted gyrotron-type applications where superconducting magnet based systems are not practical. In addition to being very small, other advantages of the electropermagnet are low fabrication cost, negligible operating and maintenance costs, zero standby power, low operating power, fast turn-on time, and no cool-down time.

This invention makes significant improvements in the electropermagnet to be more effective (higher output field strength), more efficient (lower coil power), more compact and lighter weight design, for the use of large electron beam collectors for the high power gyrotron.

These improvements better correct natural field reversals that exist at the entrance and exit of the basic electropermagnet. These improvements produce stronger unidirectional magnetic fields to better guide powerful electron beams into large external collectors and to better guide externally generated electron beams into the electropermagnet.

A significant feature of the present electropermagnet is the ability to create unidirectional output (and input) B-fields for electron beam extraction (and injection) which is essential for high average power and continuous wave output. The radial permanent magnets can be made relatively thin, and/or stepped or tapered, which allows the internal coil fields to reach through and buck the natural field reversals to low levels, and which can establish unidirectional fields on their own. Additional external coils and/or permanent magnets in many configurations can provide high strength unidirectional fields to guide powerful electron beams through radiofrequency output couplers, such as for example a Vlasov quasi optical coupler, into large external depressed collectors for very high overall efficiency.

A magnet for a power microwave tube must be extremely stable or the device will be detuned, jump to inefficient modes, or not even work at all. This has been a key problem area for magnets used for power microwave applications. The electropermagnet of the current invention provides a magnet with a highly constant magnetic field that is also tunable over a large temperature variation.

The invention adds versatility in that it provides a high magnetic field when using magnetic materials with either a high coercive force or a low coercive force. The "coercive force" is the amount of reverse magnetic field which must be applied to a magnetic material to make the magnetic flux return to zero.

The coercive force is a property or type of the material comprising the permanent magnet for which a continuum of high to low coercive force material is possible. The invention applies to the continuum, but is described herein for convenience and to facilitate description of the invention in terms of high-coercive force or low-coercive force materials. For both of these types of materials, the invention also yields desirable characteristics of higher temperature tolerance, ruggedness, and lower cost.

The present invention helps to solve the above-identified problems by eliminating the need for a superconducting magnet system in power microwave tubes.

The present invention provides a magnetic system comparatively light weight and very safe to assemble.

Additionally, the present invention may be unmagnetized when assembled and self-charged after assembly using its own internal electromagnet coils. In comparison, magnets in conventional systems are usually precharged and can often have repulsion and attraction forces approaching many tons. Thus, assembly requires massive machines to hold the pieces while being put together and clamped in place. It is often dangerous because the forces can expel pieces at high velocities.

Accordingly, the present invention will serve to improve the state of the art by providing a new and innovative magnet combination and the method of using the magnet combination in power microwave tube applications. For these applications, the present invention significantly reduces the weight of the magnet system and the cost of the magnet components, increases reliability of the power microwave tube, provides higher temperature tolerance, increases safety in assembly, adds ruggedness, and eliminates superconducting cool-down time prior to initial operation. The present invention accomplishes these solutions by providing a magnetic field in an electropermagnet that is capable of achieving a high magnetic field that can replace a superconducting magnet system.

BRIEF DESCRIPTION OF THE DRAWINGS

The drawings show preferred embodiments of a compact magnet system for a high-power millimeter-wave gyrotron and the like reference numbers in the drawings are used to designate like features consistently throughout the drawings. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
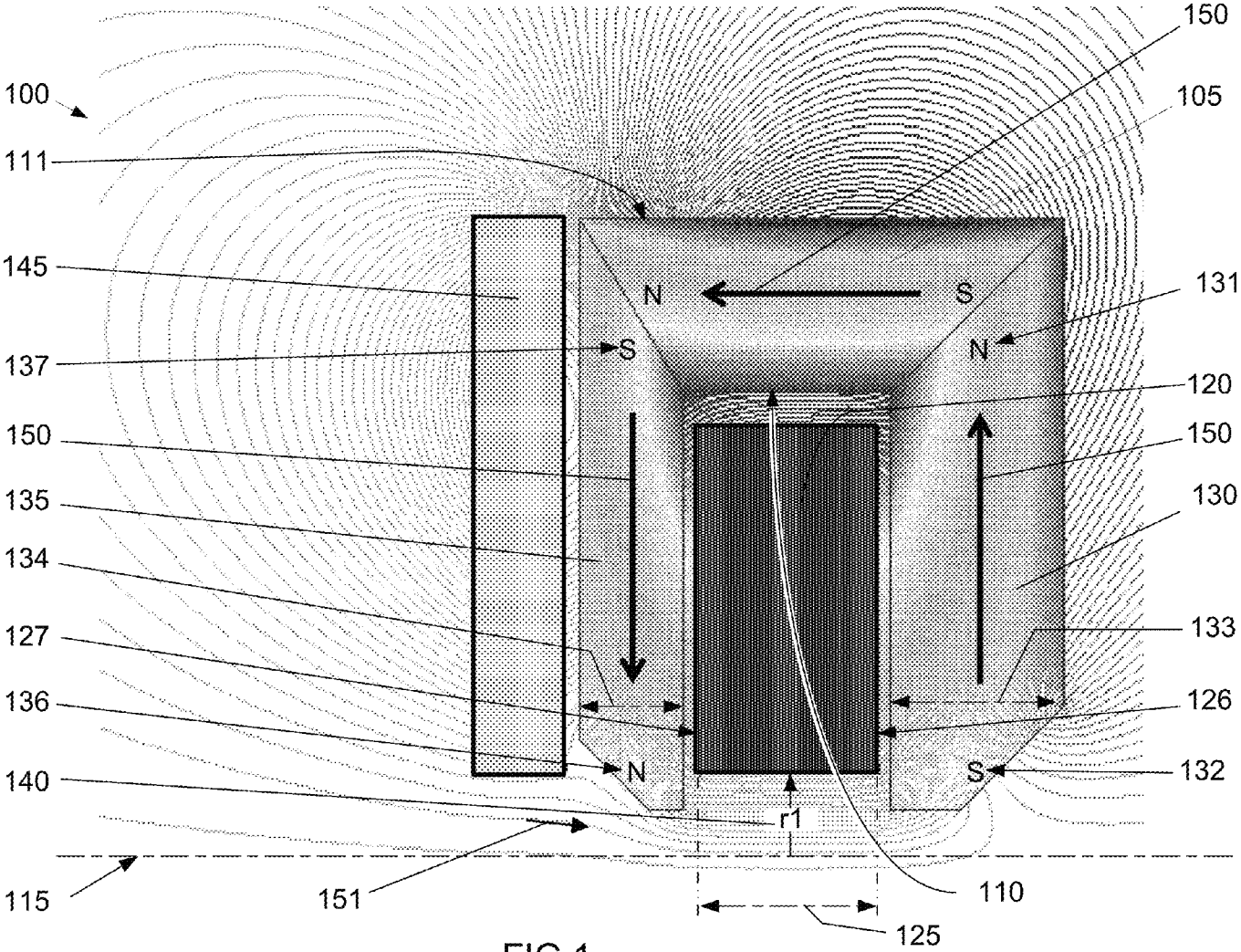
FIG. 1 is a sectional elevation view of the upper half of a first embodiment of the compact magnet system for a high-power millimeter-wave gyrotron. It is an axis-symmetric drawing.
Figure 4:
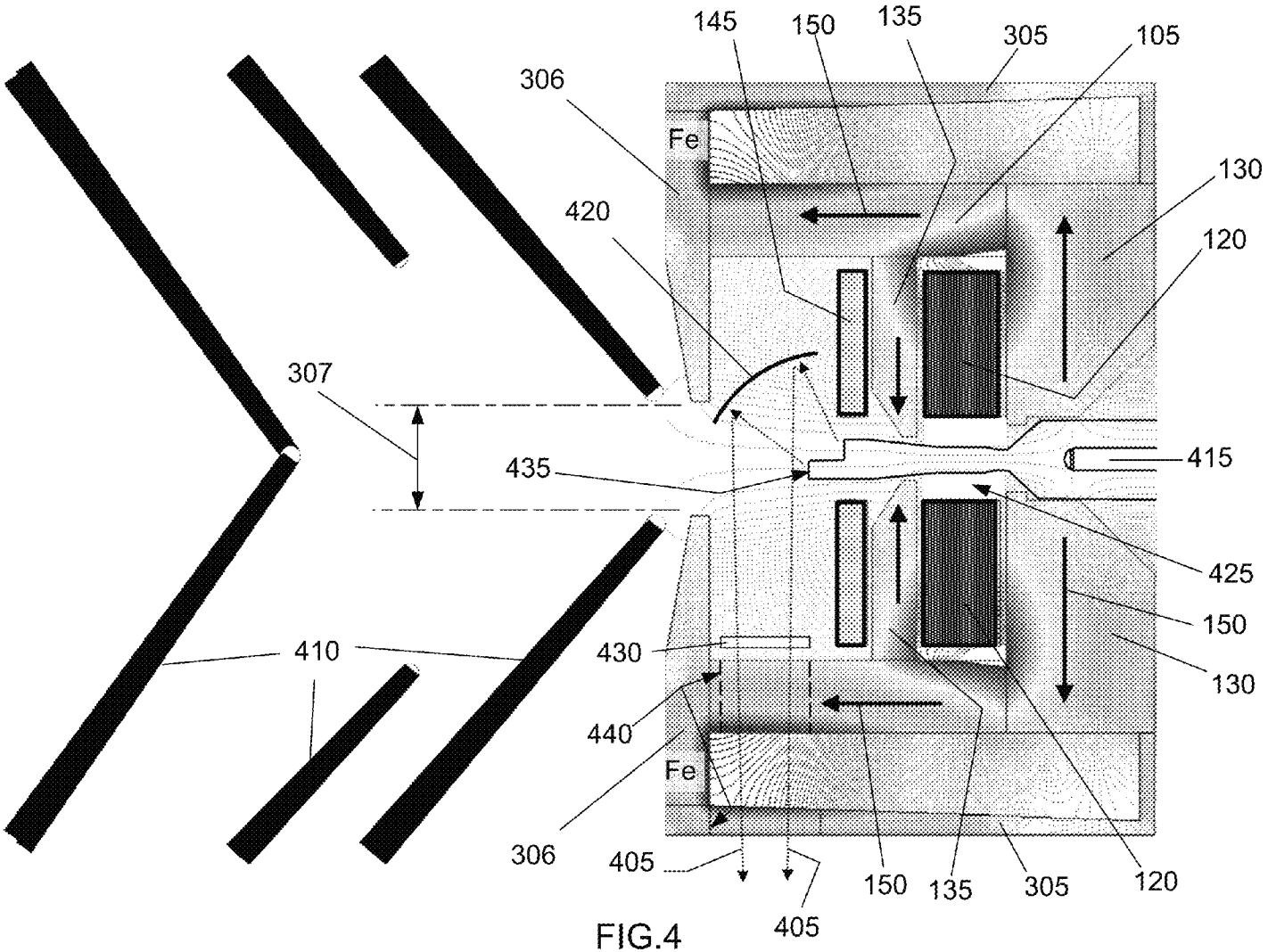
FIG. 4 is a sectional elevation view of a high power gyrotron using the third embodiment of the compact magnet system for a high-power millimeter-wave gyrotron.
Figure 5:
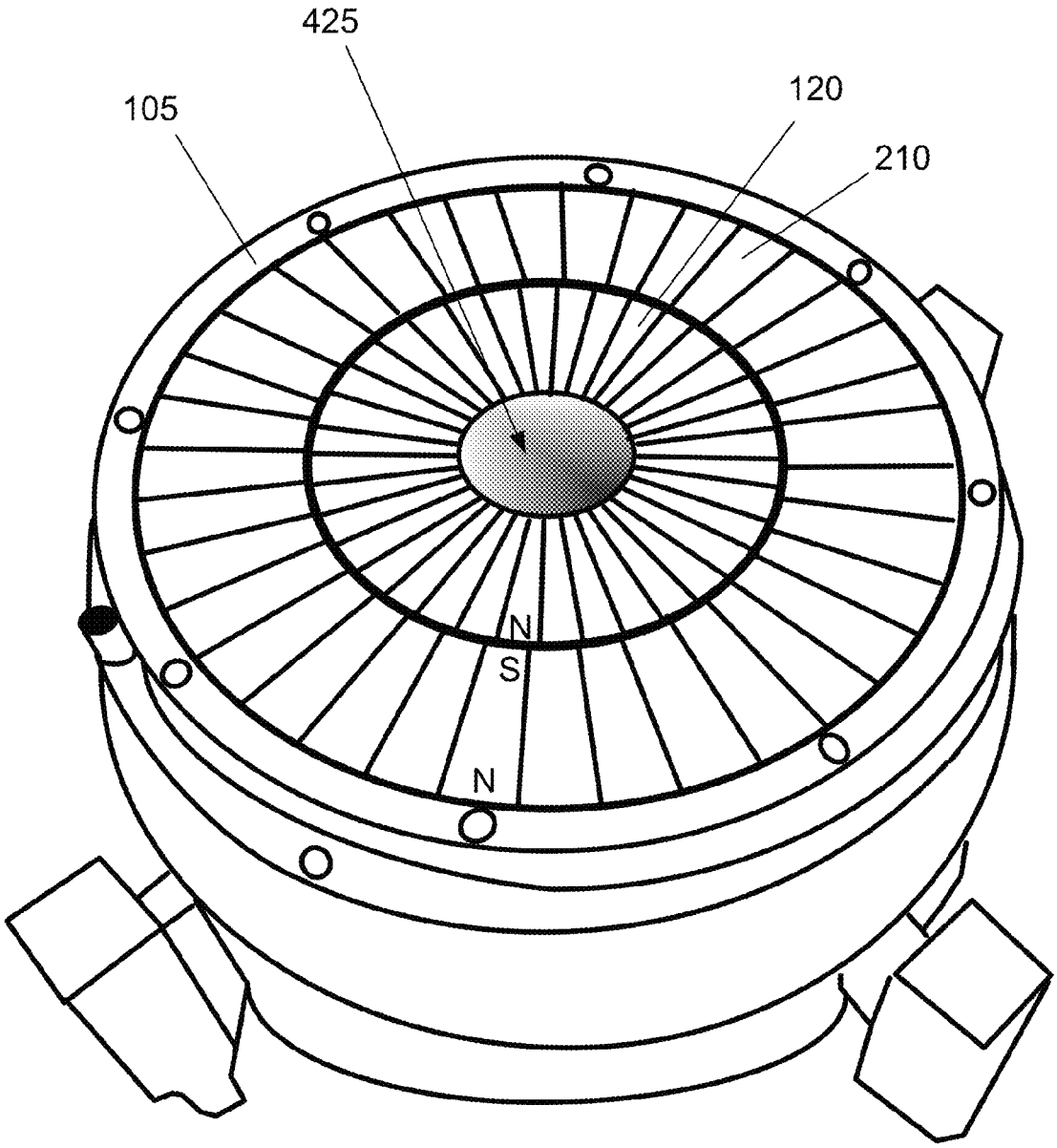
FIG. 5 is a perspective view of the second embodiment of the compact magnet system for a high-power millimeter-wave gyrotron. It is an axis-symmetric drawing.

FIG. 1 illustrates a preferred embodiment of the compact magnet system (100) for a high-power microwave tube. The high-power microwave tube is shown in FIG. 4 as an exemplary embodiment using a magnetron injection gun (415). The preferred embodiment of FIG. 1 includes: a first tubular retaining member (105); a solenoid coil (120); a plurality of first permanent magnets (130); and a plurality of second permanent magnets (135) all connected together in a specific structural arrangement.

The embodiment shown in FIG. 1 includes preferred magnetic field reversal components including the plurality of first permanent magnets (130), the plurality of second permanent magnets (135), and the solenoid coil (120).

The plurality of first permanent magnets (130) and the plurality of second permanent magnets (135) are axially thin radial magnets. It is noted that the FIG. 1 configuration is probably not the most efficient design with respect to operating power of the coils. The most efficient configuration found to date with respect to operating power is estimated to be the configuration shown in FIG. 3. The FIG. 1 embodiment is an exemplar of how magnetic field reversal correction is accomplished using the above-noted components delivering magnetic field reversal correction. The FIG. 1 embodiment is easy to make and has application to microwave power tubes if efficiency is not an overriding concern.

The first tubular retaining member (105) is preferably in the form of a right-circular hollow cylinder that has an inner wall (110) and an outer wall (111). The distance between the inner wall (110) and an outer wall is a thickness of the wall of the first tubular retaining member (105). The first tubular retaining member (105) has, i.e. defines, a central axis (115) along the length of the first tubular retaining member (105).

In a preferred embodiment, the first tubular retaining member (105) is a permanently magnetic element or combination of elements. However, in other embodiments, the first tubular retaining member (105) may be made of non-magnetized iron, stainless steel or aluminum.

The solenoid coil (120) preferably fits co-axially within the first tubular retaining member (105). Preferably, the solenoid coil (120) has an outside diameter that extends the solenoid coil so that it is adjacent to inner wall (110) of the first tubular retaining member (105), but preferably not in direct contact with the inner wall (110). The solenoid coil (120) is preferably electrically isolated from the first tubular retaining member (105). The solenoid coil (120) has a toroidal shape, similar to a donut, in that the solenoid coil (120) defines a central cavity (425), as shown in FIG. 4, of radius r1 (140) along the central axis (115). The radius r1 (140) is a calculated value and is a function of the desired output frequencies ($TE_{m,p}$ modes). The radius r1 (140) is calculated using a formula well known in the art. The radius r1 (140) that is typical for gyrotrons for the most desired frequencies is in a range of about 10 to 30 millimeters. The solenoid coil (120) has a coil width (125) along the central axis (115) defined by a first side (126) and a second side (127). Each such side extends radially outward from the central cavity (425).

The plurality of first permanent magnets (130) positioned to extend radially from the central axis (115) beginning at or below radius r1 (140) so that the plurality of first permanent magnets (130) wraps around the central axis (115) along the first side (126) of the solenoid coil (120). While the plurality of first permanent magnets (130) is adjacent to the solenoid coil (120), the first tubular retaining member (105) may be either within the first tubular retaining member (105) or adjacent to an end of the first tubular retaining member (105).

When the solenoid coil (120) is positioned within the first tubular retaining member (105) but near its end, then the plurality of first permanent magnets (130) may be configured to cover that end and still remain adjacent to the solenoid coil (120). Different embodiments showing variations of this arrangement are shown in FIGS. 1-4.

Figure 2:
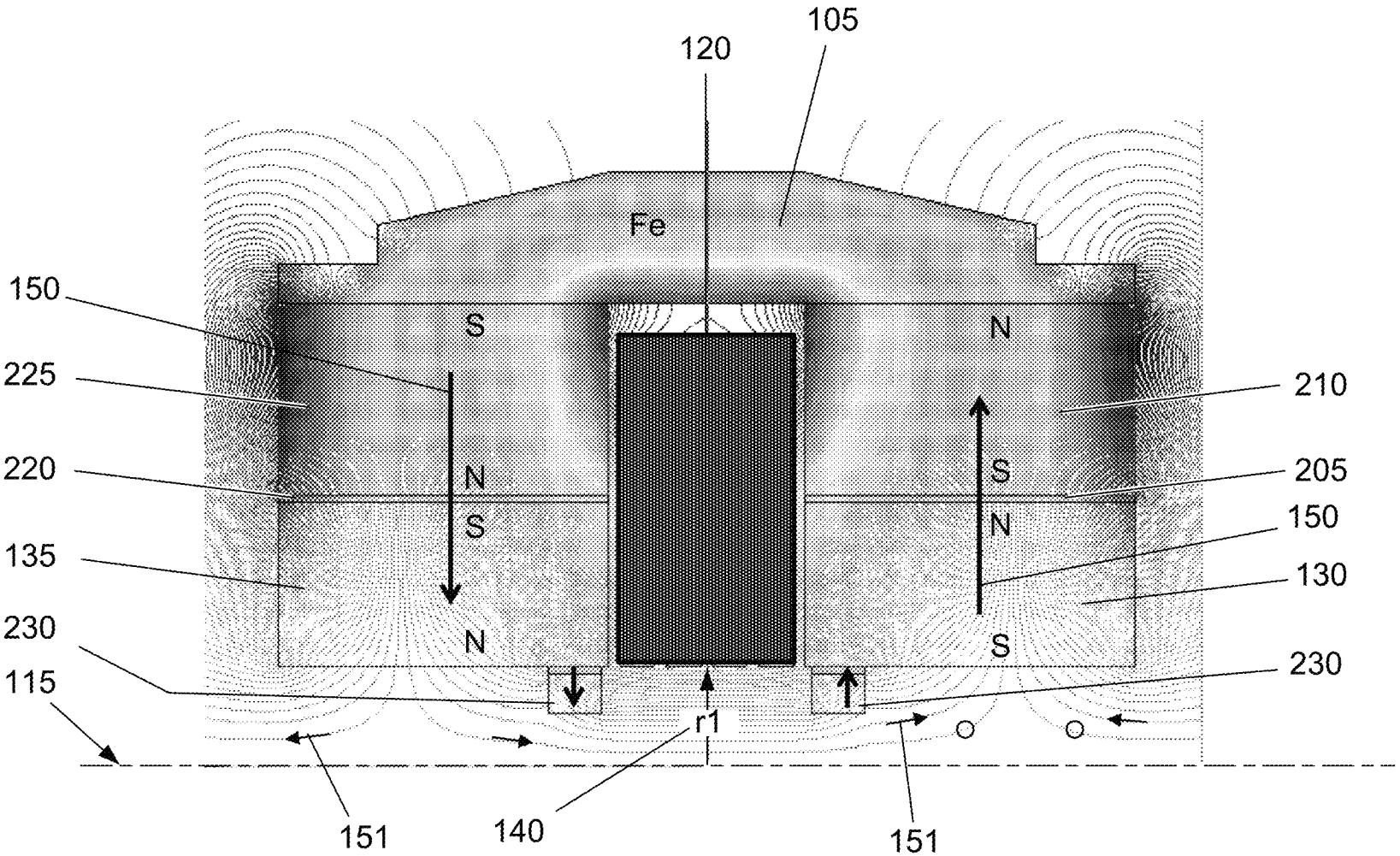
FIG. 2 is a sectional elevation view of the upper half of a second embodiment of the compact magnet system for a high-power millimeter-wave gyrotron. It is an axis-symmetric drawing.

Referring to FIG. 1, the ends of the first tubular retaining member (105) are cut at an angle to mate with the ends of the plurality of first permanent magnets (130) and the plurality of second permanent magnets (135). Other methods of joining are permissible and useful as shown in FIGS. 2 through 7. Referring to FIG. 2, the first tubular retaining member (105) encompasses the plurality of first permanent magnets (130) and the plurality of second permanent magnets (135).

Figure 3:
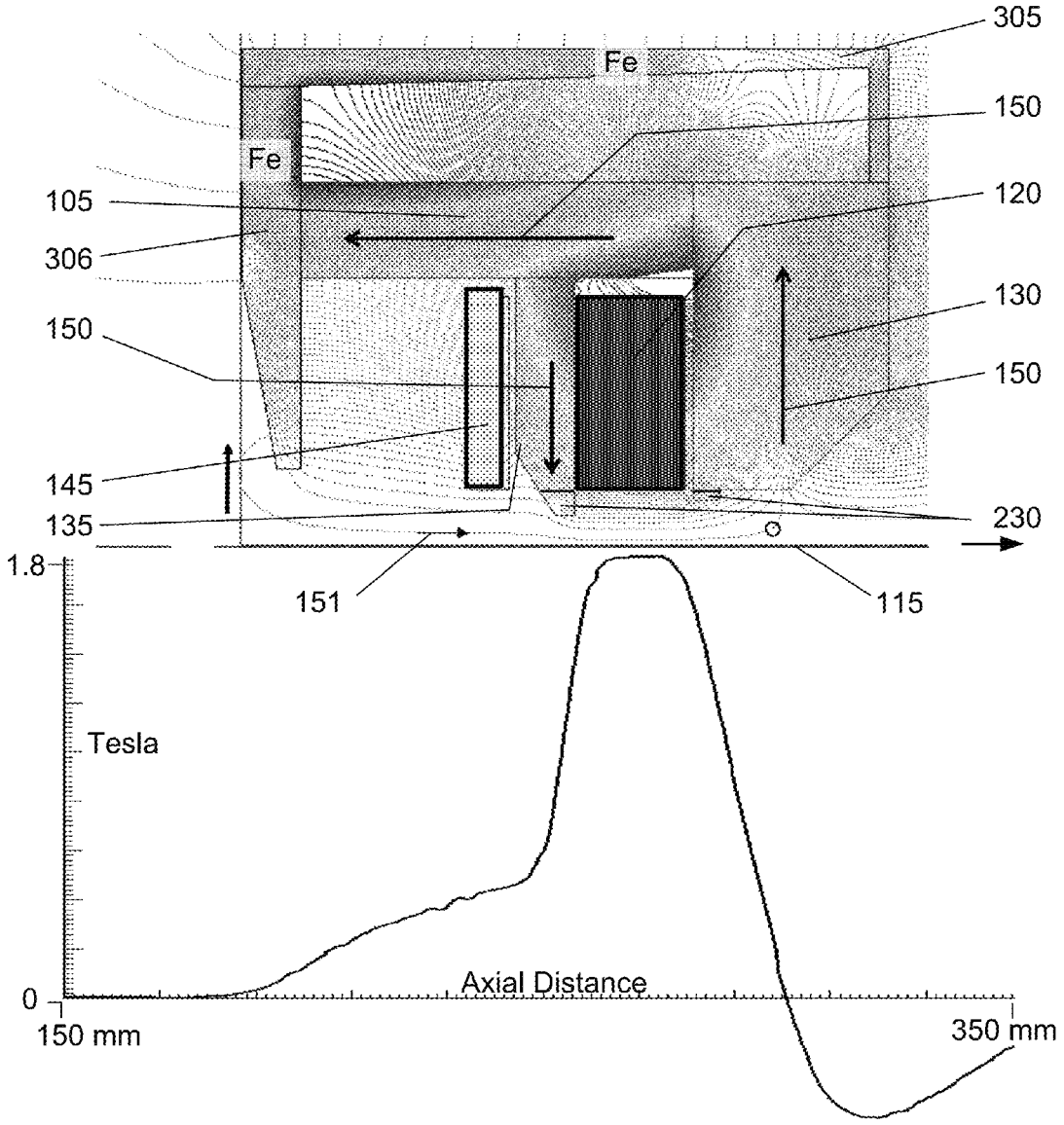
FIG. 3 is a sectional elevation view of the upper half of a third embodiment of the compact magnet system for a high-power millimeter-wave gyrotron. It is an axis-symmetric drawing.

Referring to FIG. 3, the first tubular retaining member (105) contains the plurality of second permanent magnets (135) but the plurality of second permanent magnets (135) is adjacent to the solenoid coil (120) and the end of the first tubular retaining member (105).

The permanent magnets are configured in a specific way so that their direction of magnetization creates a magnetic field within the central cavity (425) in the same direction as the magnet field created by the solenoid coil (120) when it is energized.

A direction of magnetization arrow (150), a thick vector arrow, is added atop the permanent magnets in FIG. 1. The direction of magnetization arrow (150) is the direction of the magnetic field applied by that magnet. Each thick vector arrow sitting atop a component indicates that the component is a permanent magnet in that it is permanently magnetized in the direction of the arrow. When the arrow points into or away from the central axis (115), the permanent magnets are "radial" magnets. When the arrow points in a direction parallel to the central axis (115), the permanent magnets are tube magnets. The first tubular retaining member (105) may be constructed of permanent magnetic pieces formed in the shape of a tube. In this discussion, a permanent magnet element can have both components of axial and radial magnetization, but for simplicity in explanation and for fabrication, the permanent magnets discussed herein are simple straight radial and axial permanent magnets.

The magnetic field lines (151) inside and outside of a magnet may take a different path than the direction of magnetization of the same magnet due to the collective forces of the combination of magnets. For example, the magnetic field lines (151) can even be at right angles or can oppose the magnetization of a permanent magnetic member element. This is the principle of field reversal correction that can be seen in the plot of magnetic field immediately below the plurality of second permanent magnets (135) in FIG. 3 having no magnetic field reversal with a positive magnetic field whereas plot of magnetic field immediately below the plurality of first permanent magnets (130) in FIG. 3 has magnetic field reversal indicated by its transition below the axis to a negative magnetic field.

Consistent with the direction of magnetization arrows, each first permanent magnet in the plurality of first permanent magnets (130) comprises a first magnetic north pole (131), N, and a first magnetic South Pole (132), S, wherein the same pole faces the central axis (115).

FIG. 3 also shows a plot of the calculated magnetic field in the arrangement shown. The calculated axial magnetic field plot of FIG. 3 is the magnitude of the magnetic field in Tesla, on the central axis along an axial distance in the z direction (perpendicular to the plot of the central axis immediately above). There is a uniform 1.8 Tesla field in the central cavity. This arrangement is best implemented in a shielded, low operating power electropermagnet, such as for example, a 40+ kilowatt continuous wave S=2 (second cyclotron harmonic) gyrotron of 94 gigahertz. The configuration of FIG. 3 is considered best for highest cavity field, low external (outside of the magnet) magnetic field, low weight/size, and low total coil operating power (about 3 kilowatts). It is also functional without an output coil (145) with lower output field. The output coil (145) coil may also be made up of two or more pancake solenoid coils with cooling plates or liquid cooling channels.

The plurality of second permanent magnets (135) is positioned to extend radially from the central axis (115) beginning at about radius r1 (140), as shown in FIG. 1, so that the plurality of second permanent magnets (135) wraps around the central axis (115) along the second side (127) of the solenoid coil (120), as shown in FIG. 1. In combination with the plurality of first permanent magnets (130), the first tubular retaining member (105), and the plurality of second permanent magnets (135), the solenoid coil (120) is thus enclosed.

Each second permanent magnet in the plurality of second permanent magnets (135) comprises a second magnetic north pole (136) and a second magnetic south pole (137), as respectively shown in FIG. 1, wherein the pole that faces the central axis (115) is opposite to the pole of the plurality of first permanent magnets (130) facing the central axis (115). This arrangement is necessary so that the magnetic fields from the permanent magnets enhance the uniformity of the magnetic field in the central cavity (425), as shown in FIG. 4.

In alternative embodiments, the axial width of each set of permanent magnets is different. For example, it is preferable that the plurality of first permanent magnets (130) within the first tubular retaining member (105) has a first width (133), as shown in FIG. 1, measured along the central axis (115) at radius r1 (140), the first width (133), as shown in FIG. 1, being larger than a second width (134), as shown in FIG. 1, of the plurality of second permanent magnets (135), the second width (134), as shown in FIG. 1, measured along the central axis (115) at radius r1 (140).

In other alternative embodiments, the compact magnet system (100) has a symmetrical configuration around a virtual vertical line through the middle of the solenoid coil (120). The virtual vertical line creates a hypothetical left side and a hypothetical right side. Thus, in these embodiments, the hypothetical right side is made as a mirror image or in a similar configuration as the hypothetical left side, which in effect adds a field reversal correction on the hypothetical right side to the one on the hypothetical left side.

FIG. 2 illustrates a second preferred embodiment of the compact magnet system where the first tubular retaining member (105) is made of iron, also known as Fe in its elemental designation. Iron has high magnetic permeability and this inherent characteristic of the metal helps to form a uniform high magnetic field in the central cavity (425), as shown in FIG. 4. The primary differences in the second preferred embodiment over the preferred embodiment of FIG. 1, lie in adding additional tubular retaining members and additional outer rows of permanent magnets. Also, the magnet configuration shown in FIG. 2 offers no magnetic field reversal correction, which is not necessary in some applications.

The second preferred embodiment of the compact magnet system (100) includes the same components of the FIG. 1 embodiment and in addition includes a second tubular retaining member (205), a plurality of third permanent magnets (210), a third tubular retaining member (220), and a plurality of fourth permanent magnets (225).

The second tubular retaining member (205) fits within the first tubular retaining member (105). The second tubular retaining member (205) holds or confines the plurality of first permanent magnets (130). The second tubular retaining member (205) is essentially a containment ring to structurally confine the plurality of first permanent magnets (130). Large diameter permanent magnets may be constructed in this way.

The plurality of third permanent magnets (210) is positioned to extend radially around the second tubular retaining member (205) wherein the same magnetic pole of each third permanent magnet faces the second tubular member and is opposite to the magnetic pole of each of the plurality of first permanent magnets (130) nearest the second tubular retaining member (205), as shown in FIG. 2.

The third tubular retaining member (220) fits within the first tubular retaining member (105). The third tubular retaining member (220) holds or confines the plurality of second permanent magnets (135). The third tubular retaining member (220) is essentially a containment ring to structurally confine the plurality of second permanent magnets (135).

The plurality of fourth permanent magnets (225) is positioned to extend radially around the third tubular retaining member (220) wherein the same magnetic pole of each fourth permanent magnet faces the third tubular retaining member (220) and is opposite to the magnetic pole of each of the plurality of second permanent magnets (135) nearest the third tubular retaining member (220). This arrangement is also shown in a perspective view in FIG. 5. Also, the magnet arrangement shown in FIG. 2 and FIG. 5 includes axially thick radial magnets, which prevent field correction. Thus, the magnet configuration shown in FIG. 2 and FIG. 5 offers little or no field reversal correction.

For preferred alternative embodiments, the compact magnet system (100) may further include a shell (305), shown in FIG. 3. The shell (305) is made of a magnetically permeable material, such as iron (i.e. Fe) or soft steel. The shell (305) helps to hold and align all of the components together. Thus, the shell (305) is configured to hold and align together the first tubular retaining member, the solenoid coil, plurality of first permanent magnets, and plurality of second permanent magnets.

The shell (305) increases the magnetic field in the central cavity (425), as shown in FIG. 4, by capturing radial flux from the plurality of first permanent magnets (130) and channeling that flux to the pole piece (306). The shell (305) also serves as a shield to minimize the external magnetic field of the compact magnet system (100).

The configuration (or way it is put together) shown in the FIG. 3 embodiment is probably the most efficient in terms of the lowest total electromagnet coil operating power consumption and highest magnetic field in the central cavity (425) and (corrected, or unidirectional) exit field near the pole piece (306).

The FIG. 3 configuration is estimated to deliver the most efficient field reversal correcting components, consisting of: the first tubular retaining member (105); the shell (305); a pole piece (306); the output coil (145); and the plurality of second permanent magnets (135), which have a distinctive thin and tapered shape.

The pole piece (306) helps to shape and control the magnetic field extending past the end of the first tubular retaining member (105). The pole piece (306) is located adjacent to an end of the first tubular retaining member (105) nearest to the plurality of second permanent magnets (135). The pole piece (306) is preferably tapered or angled inward toward the central cavity and it preferably extends perpendicularly from the shell (305). Angling enables fine tuning of the magnet field exiting the plurality of second permanent magnets (135). The pole piece (306) covers the end of the first tubular retaining member (105), except for a central opening having a diameter (307) that is large enough to allow an expanding electron beam to exit. In other words, the pole piece (306) does not close off the central opening where the electrons flow out of the central cavity (425) along the central axis (115) to an external collector.

In alternative embodiments, components may be added, such as an output coil (145), trim magnets (230), as referenced in FIG. 2 and FIG. 3, straddling the central cavity (425), as shown in FIG. 4, a multistage depressed collector (410), a Vlasov quasi optical coupler (also referred to herein as Vlasov-type coupler) which includes a launcher (435) and a microwave collection mirror (420) where radiofrequency output beams (405) are directed out of a hole (440) through a window (430). The launcher (435) is represented by the irregular shape within the central cavity (425).

Example 1

Figure 6:
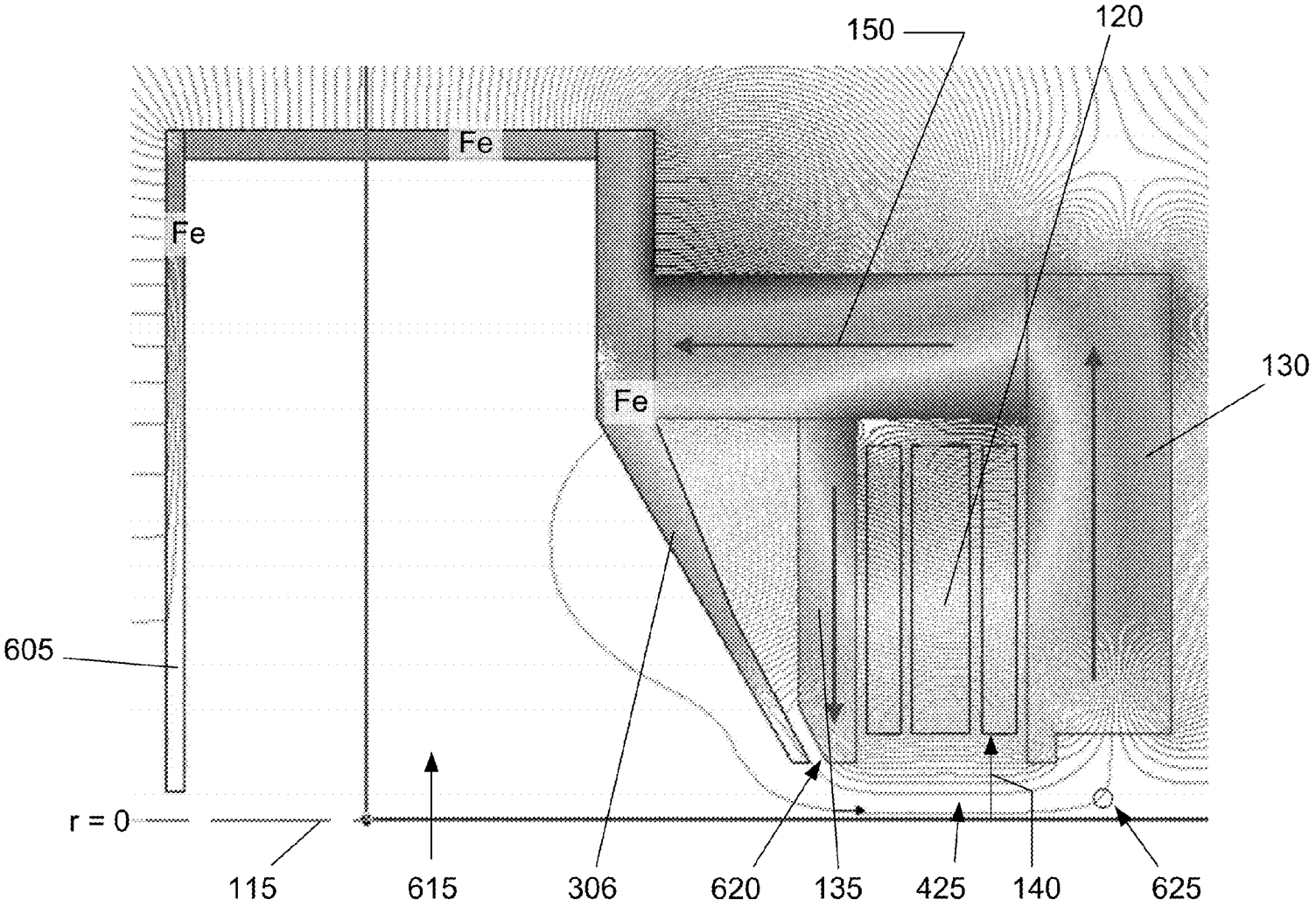
FIG. 6 is a sectional elevation view of the upper half of a very-compact, low-operating-power electropermagnet for a waveguide output millimeter-wave gyrotron.
Figure 7:
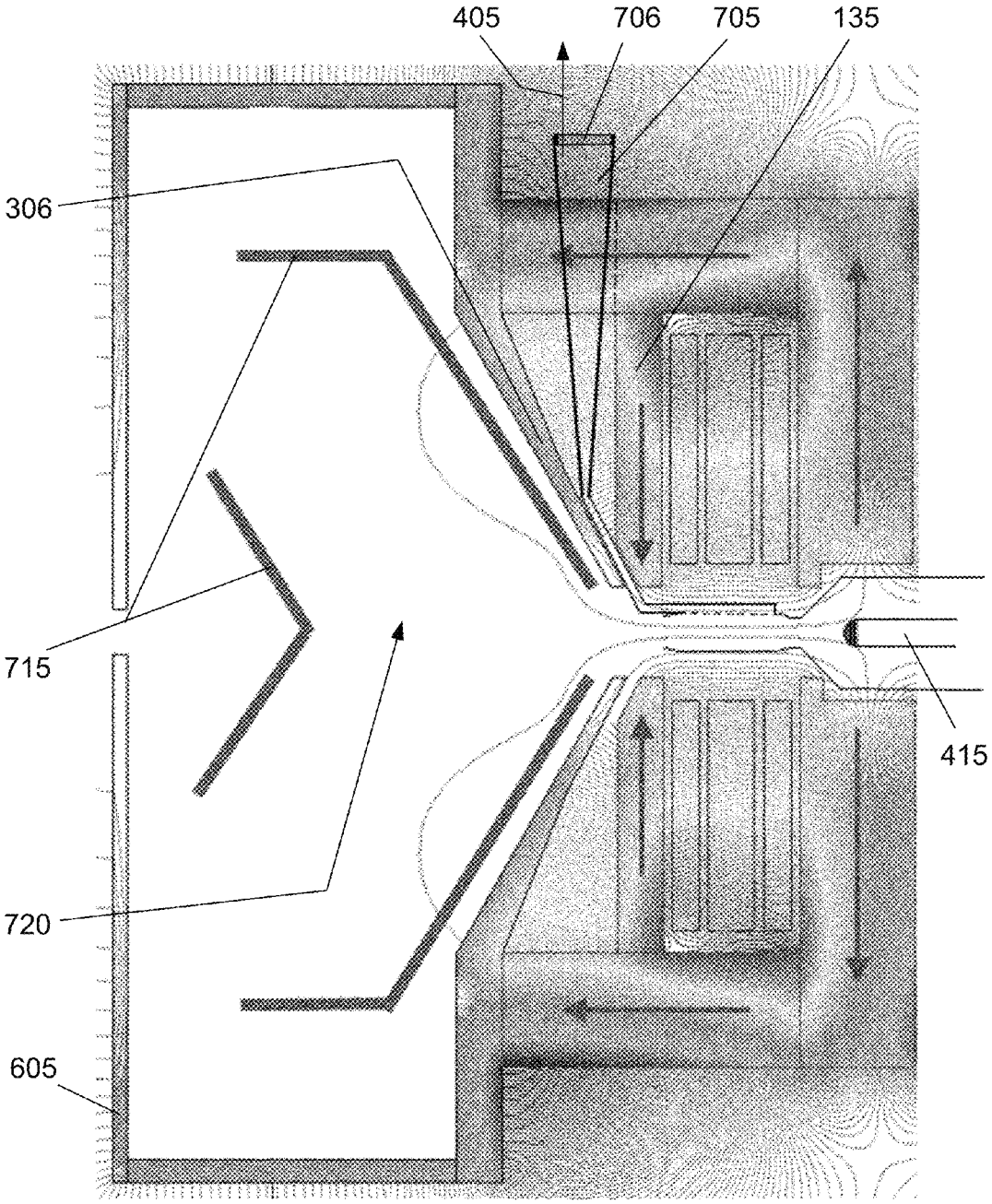
FIG. 7 is a sectional elevation view of the electropermagnet of FIG. 6 combined with a magnetron injection gun and a single-stage depressed collector.

FIG. 6 and FIG. 7 disclose an exemplary preferred embodiment employed in an electropermagnet for a gyrotron with a waveguide output. FIG. 6 shows the upper half of a sectional elevation view of this embodiment. FIG. 7 shows both upper and lower halves and adds additional components to the embodiment of FIG. 6. As shown in FIG. 6, the central cavity (425) straddles the central axis (115) and in this example is the radius r1 (140) is 15 millimeters. The central axis (115) denotes the radius of zero for the central cavity (425). The location (625) for the cathode for the magnetron injection gun (415) is indicated just above the central axis (115).

In this example, both FIG. 6 and FIG. 7 have a pole piece (306) preferably made of iron. The pole piece (306) is brought in close proximity to the plurality of second permanent magnets (135) to create a gap (620). The plurality of second permanent magnets (135) may be referred to more descriptively as the output radial permanent magnets, as shown in FIG. 7.

In this example, the pole piece (306) is angled toward the plurality of second permanent magnets. The pole piece (306) is configured to define a gap (620) between the plurality of second permanent magnets (135) and the pole piece (306). The gap (620) is configured to provide access to the central cavity (425), and more particularly to a microwave region within the center portion of the central cavity (425), to at least one output waveguide (705), as shown in FIG. 7. The output waveguide (705) preferably has a circular up-taper ending at a waveguide exit window (706), as shown in FIG. 7.

A magnetic shield (605), which may be iron or soft steel, serves as a magnetic shield for electrons transiting the free field collector region (615) as shown in FIG. 6, which as shown in FIG. 7 is typically held under a vacuum (720). The vacuum shell components, which enable drawing a vacuum (720), are not shown in either drawing.

The embodiment in this example is considered very attractive for 61 gigahertz and 28 gigahertz Industrial, scientific, and medical (ISM) Applications at 10-20 kilowatt continuous wave. There is an 11 kilogauss magnetic field in this embodiment for second harmonic $TE_{021}$ mode or first harmonic $TE_{011}$ mode operation.

This embodiment uses a single stage depressed collector (715), delivering high efficiency, with a low voltage of 20-30 kilovolts and a low magnet operating power of about 1 kilowatt, estimated.

Example 2

This example describes the embodiment of the compact magnet system shown in FIG. 3. A plurality of first permanent magnets (130) are relatively thick (relative to the plurality of second permanent magnets (135)) in the axial direction and are magnetically charged (i.e. magnetized) in the radial direction.

In the example, a plurality of second permanent magnets (135) in comparison are relatively thin in axial direction and are also magnetically charged in the radial direction but in opposite radial direction to the plurality of first permanent magnets (130).

In the example, a first tubular retaining member (105) is an outer cylinder with hollow bore (i.e. tube shaped). The first tubular retaining member (105) in this example is a permanent magnet that has a magnetic charge in the axial direction. The magnetic charge is indicated by the direction of magnetization arrow (150), which points to magnetic north. The first tubular retaining member (105) will usually (but not necessarily) have (not shown) an attached (e.g. glued) outer non-magnetic shell (e.g. stainless steel or aluminum) for strengthening, alignment, and assembly.

In the example, a pole piece (306) is an iron (but may be soft steel) pole piece that is either made as part of the gyrotron tube body, or as a separate piece that is installed when the gyrotron tube is inserted into the electropermagnet.

In the example, a shell (305) is made of iron.

In the example, a solenoid coil (120) is an internal coil assembly made up of one or more electromagnet coils with associated water or oil cooling components.

In this example, an output coil (145) is also a coil assembly made up of one or more electromagnetic coils with associated water or oil cooling components.

In this example, trim magnets (230) are positioned at the bottom edge of the plurality of first permanent magnets (130) and the plurality of second permanent magnets (135), i.e. around the edge of the central cavity. The trim magnets (230) are radially charged in the same radial directions as the larger radial magnets next to which they are positioned. Alternatively, the trim magnets (230) may be installed on the gyrotron tube body.

In this example, holes or slots exist in the plurality of second permanent magnets (135) and in the shell (305) (not shown for drawing simplicity) for connecting electrical lines (for powering the coils) and for cooling lines (for cooling the coils).

Example 3—Making an Electropermagnet

The art of making a compact magnet system (100) may be accomplished by gluing together small angle wedges (e.g. 10 degrees) of permanent magnets, magnetically charged in the radial direction.

In this example, the wedges are held together in a non-magnetic (e.g. stainless steel or aluminum) shell. In other examples, the shell (305) may also be a magnetic (e.g. iron or soft steel) containment steel ring. The permanent magnets in this example are Neodymium Iron Boron (NdFeB or NIB). Other examples may utilize magnets made of Samarium Cobalt (SmCo), Aluminum Nickle Cobalt (Al-NiCo), and others that are known.

In this example, the field strength requirement of the coils is not high and so the solenoid coil (120) is one or more coils that are simple tape wound coils (copper or aluminum tape) of uniform current density. The solenoid coil (120) is edge cooled by water (or oil) cooled plates positioned between the coils.

For other applications, when higher magnetic field strength and/or for higher efficiency (i.e. lower coil power for the same electromagnet field contribution), other coil manufacturing techniques may be employed, such as for example non-uniform current density coils and stepped density coils (as by stepping the tape thickness).

In this example, alignment steps, pins, and screws are used throughout the assembly. The attractive forces between the permanent magnet parts and iron parts are very large and can be thousands of pounds force. So, in this example, the assembly is done by machine. The assembly machine is made with aluminum plates separated by large screw(s) where the parts are attached to the plates (as by screws) and the plates are separated by a long threaded heavy screw(s) to which crank handle(s) or motors are attached, and held by an aluminum framework.

In this example, the parts are initially separated by large enough distance (e.g. 1 meter) so that the magnetic parts are safely installed on the aluminum plates by hand. Then, the magnetic parts are screwed together by turning the large screw(s) separating the aluminum plates, the forces growing large as the parts approach contact.

In this example, the assembly of compact magnet system includes a compatible gyrotron. The following steps are taken with reference to FIG. 3:

Step 1): Attach the plurality of first permanent magnets (130) within the first tubular retaining member (105). The first tubular retaining member (105) is an axial cylindrical permanent magnet. This assembly is accomplished by using widely separated aluminum plates of the assembly machine, then screwing the components together. The direction of magnetic field of the first tubular retaining member (105) must be respected, as per FIG. 3.

Step 2): Insert the solenoid coil (120), which in this case is a coil assembly into the assembly made in Step 1 above. Care is taken to align the electrical and cooling connections to the holes in first tubular retaining member (105).

Alternately, the coil assembly may be placed in position relative to the plurality of first permanent magnets (130) and then slid into the first tubular retaining member (105). Slots cut to the end of the first tubular retaining member (105) are for the electrical wires and cooling lines and the shell (305) is installed to contact with the plurality of first permanent magnets (130).

Step 3): The assembly from Steps 1) and 2) is attached to an aluminum plate of the assembly machine. The plurality of second permanent magnets (135) is attached to another aluminum plate. Then, the plurality of second permanent magnets (135) is inserted into first tubular retaining member (105). The plurality of second permanent magnets (135) are allowed to press against the solenoid coil (120), capturing the solenoid coil (120) between the plurality of first permanent magnets (130) and the plurality of second permanent magnets (135). Direct contact with the solenoid coil (120) enables the cooling system of the solenoid coil (120) to also cool the plurality of first permanent magnets (130) and the plurality of second permanent magnets (135).

Such direct contact is important when using temperature sensitive permanent magnet materials such as Neodymium Iron Boron.

The plurality of second permanent magnets (135) may be allowed to float, by not being mechanically captured in another way (other than by the attractive magnetic forces), so as to allow for thermal expansion of the solenoid coil (120).

Step 4): The output coil (145), if used, is then inserted into the first tubular retaining member (105), being careful to align with the electrical and cooling lines to holes or slots in the plurality of second permanent magnets (135).

Step 5): The shell (305) made of iron is next installed over the above assembly using the assembly machine. This is done being careful to align holes or slots to the electrical wires and cooling lines of the output coil (145).

Step 6): The gyrotron tube, which includes pole piece (306) and trim radial magnets as preassembled parts of the gyrotron tube, is inserted into the assembly above using the assembly machine.

Step 7): The remaining electrical wires and cooling lines are attached and the electropermagnet gyrotron is assembled.

Example 3—Magnetic Flux from the Electropermagnet

Reference is made to FIG. 3, showing the magnetic field plotted along the length along the central axis of a W-band gyrotron, and to FIG. 4 showing a general arrangement of the components. The plotted magnetic field values are calculated by ANSOFT MAXWELL 2D. This example uses a Neodymium Iron Boron permanent magnet material with a residual flux density of 14.0 kilogauss, but it is noted that other materials including low coercive force Alnico also work well.

In this example, the trim magnets (230) are small, inner-radial magnets that serve to flatten and shape the central cavity (425) magnetic field for radiofrequency efficiency enhancement, and can be placed on the gyrotron tube body after baking.

In this example, a magnetron injection gun (415) cathode is placed at the location (625) as shown in FIG. 4. The cathode produces a helical electron beam that follows an inner flux line with 1.2 millimeter radius in the central cavity (425) for optimal $TE_{021}$ mode s=2 (second cyclotron harmonic) interaction. The helical beam travels to the multistage depressed collector (410).

While this example is for a 30 mm internal diameter bore (central cavity (425) diameter), adequate for at least 40 kilowatt continuous wave emissions and 100 kilowatt pulse at 94 gigahertz due to electric field and space charge limits in a thru-bore magnetron injection gun, the concept is scalable to larger sizes for radiofrequency powers of hundreds of kilowatt continuous wave emissions.

In this example, the multistage depressed collector (410) is cooled using water or air as a cooling medium. The multistage depressed collector (410) may be operated at a "depressed" electrical potential (voltage) relative to the body of the magnetron injection gun (415).

In a typical electron beam device, the body of the electron beam device is at ground potential and the cathode potential is negative with respect to the body. The collector voltage is "depressed" by applying a potential that is between the cathode potential and ground. By operating the collector at a depressed state, the negative electric field within the collector slows the moving electrons so that the electrons can be collected at reduced velocities. This method increases the electrical efficiency of the radiofrequency device as well as reducing undesirable heat generation within the collector.

In this example, a radiofrequency output beam (405) is obtained using a Vlasov quasi optical coupler. The radiofrequency output beam (405) is formed by a waveguide section that receives the microwave energy in a high-order mode at a first end and yields the quasi-optical fundamental-mode beam at a second end in a conversion process well known in the art. The energy that comes out of the Vlasov quasi optical coupler is intercepted by a mirror whose profile is chosen so as to focus this energy or guide it in a determined direction.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application at least to the power microwave tube industry.

What is claimed is:

1. A compact magnet system for a high-power microwave tube comprising:

a first tubular retaining member having an inner wall, the first tubular retaining member made of a material selected from the group consisting of iron, a permanently magnetic element, stainless steel and aluminum, the first tubular retaining member defining a central axis;

a solenoid coil fitting within the first tubular retaining member, the solenoid coil defining a central cavity of radius r1 along the central axis, the solenoid coil having a coil width defined by a first side and a second side;

a plurality of first permanent magnets positioned to extend radially from the central axis beginning at or below radius r1 so that the plurality of first permanent magnets wraps around the central axis along the first side of the solenoid coil;

each first permanent magnet in the plurality of first permanent magnets comprises a first magnetic north pole and a first magnetic south pole wherein the same pole in each one of the plurality of first permanent magnets faces the central axis;

a plurality of second permanent magnets positioned to extend radially from the central axis beginning at about radius r1 so that the plurality of second permanent magnets wraps around the central axis along the second side of the solenoid coil;

each second permanent magnet in the plurality of second permanent magnets comprises a second magnetic north pole and a second magnetic south pole wherein the pole in each one of the second plurality of second permanent magnets that faces the central axis is opposite to the pole of the plurality of first permanent magnets facing the central axis;

wherein the plurality of first permanent magnets within the first tubular retaining member has a first width measured along the central axis at radius r1, said first width being larger than a second width of the plurality of second permanent magnets, said second width measured along the central axis at radius r1.

2. The compact magnet system of claim 1, wherein the first tubular retaining member is made of iron, and further comprising:

a second tubular retaining member fitting within the first tubular retaining member and confining within the second tubular retaining member the plurality of first permanent magnets;

a plurality of third permanent magnets positioned to extend radially around the second tubular retaining member wherein the same magnetic pole of each third permanent magnet faces the second tubular retaining member and is opposite to the magnetic pole of each of the plurality of first permanent magnets nearest the second tubular retaining member;

a third tubular retaining member fitting within the first tubular retaining member and confining therewithin the plurality of second permanent magnets; and a plurality of fourth permanent magnets positioned to extend radially around the third tubular retaining member wherein the same magnetic pole of each fourth permanent magnet faces the third tubular retaining member and is opposite to the magnetic pole of each of the plurality of second permanent magnets nearest the third tubular retaining member.

3. The compact magnet system of claim 1, wherein the first tubular retaining member is a permanently magnetic element, the compact magnet system further comprising a shell made of a magnetically permeable material, the shell configured to hold and align together the first tubular retaining member, the solenoid coil, plurality of first permanent magnets, and plurality of second permanent magnets.

4. The compact magnet system of claim 1, further comprising a pole piece, the pole piece made of a magnetically permeable material, the pole piece located adjacent to an end of the first tubular retaining member nearest to the plurality of second permanent magnets.

5. The compact magnet system of claim 4, wherein the pole piece covering said end except for a central opening having a diameter that is large enough to allow an expanding electron beam to exit.

6. The compact magnet system of claim 4, wherein the pole piece is angled toward the plurality of second permanent magnets and configured to define a gap between the plurality of second permanent magnets and the pole piece, the gap configured to provide access from a central cavity to at least one output waveguide.

7. The compact magnet system of claim 6, further comprising the at least one output waveguide having a circular up-taper, the at least one output waveguide extending from within the central cavity and configured to pass through the gap and thereafter to define a circular up-taper.

* * * * *